US009117359B2

(12) United States Patent
Hanses et al.

(10) Patent No.: US 9,117,359 B2
(45) Date of Patent: Aug. 25, 2015

(54) PHOTOELECTRIC SMOKE DETECTOR AND PROCESS FOR TESTING THE PHOTOELECTRIC SMOKE DETECTOR

(75) Inventors: Thomas Hanses, Feldkirchen-Westerham (DE); Gerhard Gruener, Riemerling (DE); Wolfgang Werkmeister, Poing (DE); Joerg Tuermer, Ebersberg (DE)

(73) Assignee: Robert Bosch GmbH, Stuttgart (DE)

( * ) Notice: Subject to any disclaimer, the term of this patent is extended or adjusted under 35 U.S.C. 154(b) by 162 days.

(21) Appl. No.: 14/008,003

(22) PCT Filed: Mar. 28, 2011

(86) PCT No.: PCT/EP2011/054723

§ 371 (c)(1), (2), (4) Date: Sep. 27, 2013

(87) PCT Pub. No.: WO2012/130276

PCT Pub. Date: Oct. 4, 2012

(65) Prior Publication Data

US 2014/0015668 A1 Jan. 16, 2014

(51) Int. Cl.

| | |
|---|---|
| ***G08B 17/10*** | (2006.01) |
| ***G08B 29/14*** | (2006.01) |
| ***G08B 17/107*** | (2006.01) |
| ***G08B 29/24*** | (2006.01) |

(52) U.S. Cl.

CPC ..... *G08B 29/145* (2013.01); *G08B 17/107* (2013.01); *G08B 29/24* (2013.01)

(58) Field of Classification Search

USPC ..... 340/577, 627, 628, 630

See application file for complete search history.

(56) References Cited

U.S. PATENT DOCUMENTS 4,249,418 A * 2/1981 Ebata ..... 374/117
4,288,791 A * 9/1981 Malinowski ..... 340/630
5,859,706 A * 1/1999 Nagashima et al. ..... 356/394

FOREIGN PATENT DOCUMENTS

| | | | |
|---|---|---|---|
| JP | 63217232 A | * | 9/1988 |
| JP | 2010122995 | | 6/2010 |
| JP | 2010122995 A | * | 6/2010 |
| WO | 0072282 | | 11/2000 |

OTHER PUBLICATIONS

PCT/EP2011/054723 International Search Report and Written Opinion dated Aug. 30, 2011 (10 pages).

* cited by examiner

*Primary Examiner* — Travis Hunnings
(74) *Attorney, Agent, or Firm* — Michael Best & Friedrich LLP

(57) ABSTRACT

A photoelectric smoke detector 1 for detecting smoke particles 4 is disclosed, the smoke detector 1 comprising: a light emitting element 5, a light receiving element 6 for receiving light 8 emitted by the light emitting element 5 and scattered by the smoke particles 4 and for outputting a detection signal 12 obtained by photoelectrical converting the received light 10, 11, an amplifier circuit 13 for amplifying the detection signal 12 and providing an amplified output signal 14, wherein the amplified output signal 14 may be divided into an offset-signal 20 and an amplified detection signal 21, whereby the photoelectric smoke detector 1 is adapted to operate in a pulsed mode, so that the detection signal 12 comprises high-frequency components, whereby the amplified detection signal 21 is determined by high-frequency components of the detection signal 12 and that the offset-signal 20 is determined by low-frequency components of the detection signal 12 and/or by low-frequency components of at least an intermediate signal based on the detection signal 12, and whereby the amplifier circuit 13 is adapted to transfer the high-frequency components with a higher gain and to transfer the low-frequency components with a lower gain in order to improve the signal ratio between the amplified detection signal 21 and the offset-signal 20.

18 Claims, 5 Drawing Sheets

PHOTOELECTRIC SMOKE DETECTOR AND PROCESS FOR TESTING THE PHOTOELECTRIC SMOKE DETECTOR

BACKGROUND OF THE INVENTION

The invention relates to a photoelectric smoke detector, more specifically the invention relates to a photoelectric smoke detector for detecting smoke particles comprising a light emitting element, a light receiving element for receiving light emitted by the light emitting element and scattered by the smoke particles and for outputting a detection signal obtained by photo-electrically converting the received light, and an amplifier circuit for amplifying the detection signal and providing an amplified output signal, wherein the amplified output signal may be divided into an offset-signal and an amplified detection signal, whereby the photoelectric smoke detector is adapted to operate in a pulsed mode, so that the detection signal comprises high-frequency components. The invention furthermore relates to a process for testing the photoelectric smoke detector.

Photoelectric smoke detectors are widely used in private households as well as in industrial or public environments as detecting devices, which allow an early detection of smoke particles and therefore an early detection of fire.

A photoelectric smoke detector and a disaster monitoring system using a photoelectric smoke detector is disclosed in the European Patent Application EP 755 037 A1, probably representing the closest prior art. The smoke detector comprises a light emitting element for emitting light, a light receiving element for receiving the light emitted from said light emitting element and outputting a detection signal obtained by photo-electrically converting the received light and a calculation/comparison unit for calculating the level difference or the level ratio between the light emission zero point detection signal from said light receiving element which has received the light from said light emitting element and the putting-off zero point detection signal from said light receiving element when said light emitting element is put off and comparing the level difference or the level ratio with a preset determination level and a determination unit for determining the normality or the abnormality of the operation of said light emitting element, said light receiving element and a peripheral circuit from the result of comparison effected by said calculation/comparison unit.

SUMMARY OF THE INVENTION

According to the invention, a photoelectric smoke detector, which is operable to detect smoke particles is disclosed. The photoelectric smoke detector is preferably embodied as a wall or ceiling detector in a housing and may be mounted in private households or public or industrial environments. The photoelectric smoke detector is preferably realized as an in-door detector.

Optional the photoelectric smoke detector is a stand-alone system including a warning device like a siren or a warning light. Alternatively the photoelectric smoke detector is part of a monitoring system comprising a plurality of such photoelectric smoke detectors, which are controlled and supervised by a central monitoring station.

The photoelectric smoke detector comprises a light emitting element, which is operable to emit light and is preferably embodied as a LED (light emitting diode). Furthermore a light receiving element, preferably a photodiode, is provided for receiving a part of the light being emitted by the light emitting element and being scattered by the smoke particles.

In a preferred realization, the optical axis of the light emitting element and the light receiving element are arranged non-parallel and non-identical, but cross or meet in an intersection area. The intersection area may be arranged in a housing to allow the smoke particles to enter into the intersection area but being optically covered in order to prevent disturbing light from the environment to enter into the intersection area.

The underlying idea of the measurement principle is that in case of absence of smoke particles in the intersection area no light or only noise light will be scattered in the direction of the light receiving element, so that the light receiving element will receive no light or only noise light. In case of presence of smoke particles in the intersection area, a part of the light from the light emitting element will be scattered by the smoke particles in the direction of the light receiving element, so that the light receiving element will receive the scattered light, which is an indicator for the smoke particles and consequently an indicator for a fire in the environment producing the smoke particles.

The light receiving element is operable to convert the received light into an electrical signal, which will be called detection signal in the context of this invention.

An amplifier circuit is adapted and connected for amplifying the detection signal into an amplified output signal. In a general view of the invention, the amplifier circuit may be based on a digital system. But it is more preferred that the amplifier circuit is an analog amplifier. The amplifier circuit may comprise amplifying modules, filter modules etc. As the amplifier circuit is not an ideal but a real amplifier the amplified output signal may—for the sake of definition—be divided into parts, preferably two parts. One part is an offset-signal, which is based by a noise offset of the amplifier circuit or other disturbing noise. The other part is the amplified detection signal carrying the information of the detection signal.

The photoelectric smoke detector works in a pulsed mode, whereby one or more pulses of light are emitted from the light emitting element, so that the detection signal comprises high-frequency components. Preferably high-frequency shall mean frequencies higher than a threshold frequency, which may be defined as 30 $f=a*(1/T)$ with T being defined as the length of the pulses of light (FWHM). The factor a is preferably at least 0.1, preferably at least 0.5 and especially at least 1.

According to the invention, the amplified detection signal is determined or based on the high frequency components and thus carries the information of received 35 light. The offset-signal may be determined by low-frequency components and/or by low-frequency components of at least an intermediate signal based on the detection signal. Such low-frequency components may for example result from noise of real amplifiers in the amplifier circuit. Low-frequency components shall comprise d.c. voltage signals and preferably frequencies lower than the frequencies of the high-frequencies-components.

In order to enhance the ratio between the amplified detection signal and the offset-signal the amplifier circuit is operable to transfer the high-frequency components with a higher gain than the low-frequency components. The lower gain of the low-frequency-components may comprise a gain of zero, so that the lower-frequency components are damped or suppressed.

It is a consideration of the invention that photoelectric smoke detectors according to the prior art suffer from the fact that offset-signals of the output-signal are often temperature sensitive, so that the photoelectric smoke detectors must be temperature-compensated in order to allow a high selectivity for smoke particles. Without a temperature compensation, the photoelectric smoke detectors according to the prior art could not distinguish between the appearance of smoke particles and the raise of temperature as the appearance of smoke particles leads to an increase of the amplified detection signal and the raise of the temperature leads to an increase of the offset-signal, so that both occurrences lead an increase of the amplified output signal. Consequently, high-sophisticated calibrating procedures were developed to distinguish between the two occurrences.

In contrast the photoelectric smoke detector according to the invention uses high-frequency components of the detector signal as a basis for the amplified detection signal and thus for detection of the smoke particles, whereas the offset-signal is suppressed or eliminated, which comprises the low-frequency components of the signal chain and thus comprises i. a. the temperature drift changes of the amplified output signal. As a result, the photoelectric smoke detector according to the invention is free or nearly free from effects resulting from low-frequency components and is consequently free or nearly free from temperature drift effects.

In a preferred embodiment of the invention the photoelectric smoke detector is realized so that in a normal mode, especially in an operational or monitoring mode, the ratio between the amplified detection signal and the offset-signal is higher than 5:1, 8:1 or even 10:1. In the normal mode, no smoke particles are present in the intersection area. Theoretically no light emitted by the light emitting element is scattered by the smoke particles. But some light is usually scattered by walls of the photoelectric smoke detector, especially by walls of the housing or labyrinth as described above, so that also in normal mode the amplified detection signal is unequal zero. For example in a digital evaluation device the digital digits for the offset-signal maybe less than 4, preferably less than 3, especially less than 2, whereas the digital digits for the amplified detection signal may be more than 10, preferably more than 15 and especially more than 20.

As already explained above the photoelectric smoke detector according to the invention is operated in a pulsed mode, whereby in a preferred implementation the pulse widths of the light pulses from the light emitting element are shorter than 10 ms, preferably shorter than 5 ms and especially shorter than 1 rns. A possible realization shows a pulse length of 200 us. All values are defined as FWHM (Full width at half maximum). Consequently the high-frequency components have frequencies higher than 10 Hz, preferably higher than 50 Hz, especially higher than 100 Hz.

In general it appears possible to realize the different gains of the low-frequency and the high-frequency components by using digital or analogue filters. In a practical preferred embodiment, the amplifier circuit comprises a main amplification stage which is adapted to amplify the high-frequency components with a first gain and to amplify offset-signals of the amplifier circuit as part of the low-frequency components with a second gain, whereby the first gain is higher than the second gain. It is for example possible that the first gain is more than 10 times, preferably more than 30 times and especially more than 50 times higher than the second gain.

In a possible realization, the main amplification stage comprises an operational amplifier with a negative feedback branch, which couples the signals from the low-frequency components and the high-frequency components back, whereby the high-frequency components are more damped than the low-frequency components. Especially the main amplification stage is a voltage-voltage-amplifier. By damping the high-frequency components in the feed-back branch, the gain of the high-frequency components is enhanced compared to the gain of the low-frequency components, so that the signal ratio between the amplified detection signal and the offset-signal is improved.

As an alternative or a further development of the invention, the amplifier circuit comprises a pre-amplification stage for pre-amplification of the detection signal, whereby the main amplification stage and the pre-amplification stage are d. c. or low-frequency isolated from each other so that no low-frequency-components or the pre-amplified detection signal are transferred to the main amplification stage. Especially, the pre-amplification stage is a current-voltage-amplifier or -converter. The pre-amplification may also comprise an operational amplifier. One possible technical solution for d.c.—separating of the main amplification and the pre-amplification stage is one or more capacitors connected in series in the signal path of the pre-amplified detection signal. Also this measure leads to an improvement of the signal ratio between the amplified detection signal and the offset-signal.

A further subject-matter of the invention is a process for testing the photoelectric smoke detector. In a first step the light emitting element is activated in a test mode for at least one pulse, the pulse having a pulse length of preferably shorter than 10 ms, preferably shorter than 5 ms and especially shorter than 1 ms. A possible realization shows a pulse length of 200 IJs (FWHM). In a second step, the amplified output signal obtained as a response on the emitted at least one pulse as a test output signal is detected. In a third step the test output signal is compared with a reference signal. Instead of comparing the test output signal with a reference signal in its entirety or in addition, it is also possible to compare only characteristic data of the signals, like minimum value, maximum value, amplitude, width, steepness, form etc. or static values.

In case the comparison is positive according to definable rules, the status of the photoelectric smoke detector is evaluated as OK, in case the comparison is negative, the status of the photoelectric smoke detector is evaluated as nOK (not OK, defect). In a simple test the maximum value of the test output signal is evaluated. In case the maximum value is below a threshold defined by the reference signal, it is assumed that the photoelectric smoke detector is soiled and thus nOK.

It is—again—one finding of the invention that the test procedure can be performed regardless of the temperature of the photoelectric smoke detector as different temperatures have nearly or no influence on the amplified (test) output signal. Consequently the test procedure can be performed in a high quality.

In a possible realization, the reference signal is a real signal, which is generated by taking an amplified output signal with deactivated light emitting element. This signal represents mainly the offset-signal of the amplified output signal. The difference between the reference signal and the test output signal is determined by the amplified detection signal. Alternatively an artificial or calculated signal or characteristic data thereof may be used.

Besides the test result OK/nOK a limit value may be generated on basis of the comparison of the test output signal and the reference signal, defining a threshold, whereby an alarm signal or a nOK status is output in case the maximum value of the amplified output signal obtained as a response to light pulse is below the threshold during normal operation.

Although it was assumed that the amplified output signal and other signals have positive values, maximum values were defined as a testing criteria. It shall be underlined, that in case the amplified output signals have negative values, minimum values or maximum of absolute values shall be used.

BRIEF DESCRIPTION OF THE DRAWINGS

Further advantages, features or characteristics of the invention are disclosed by the following description of a preferred embodiment of the invention and the figures as attached. The figures show.

DETAILED DESCRIPTION

Figure 1A:
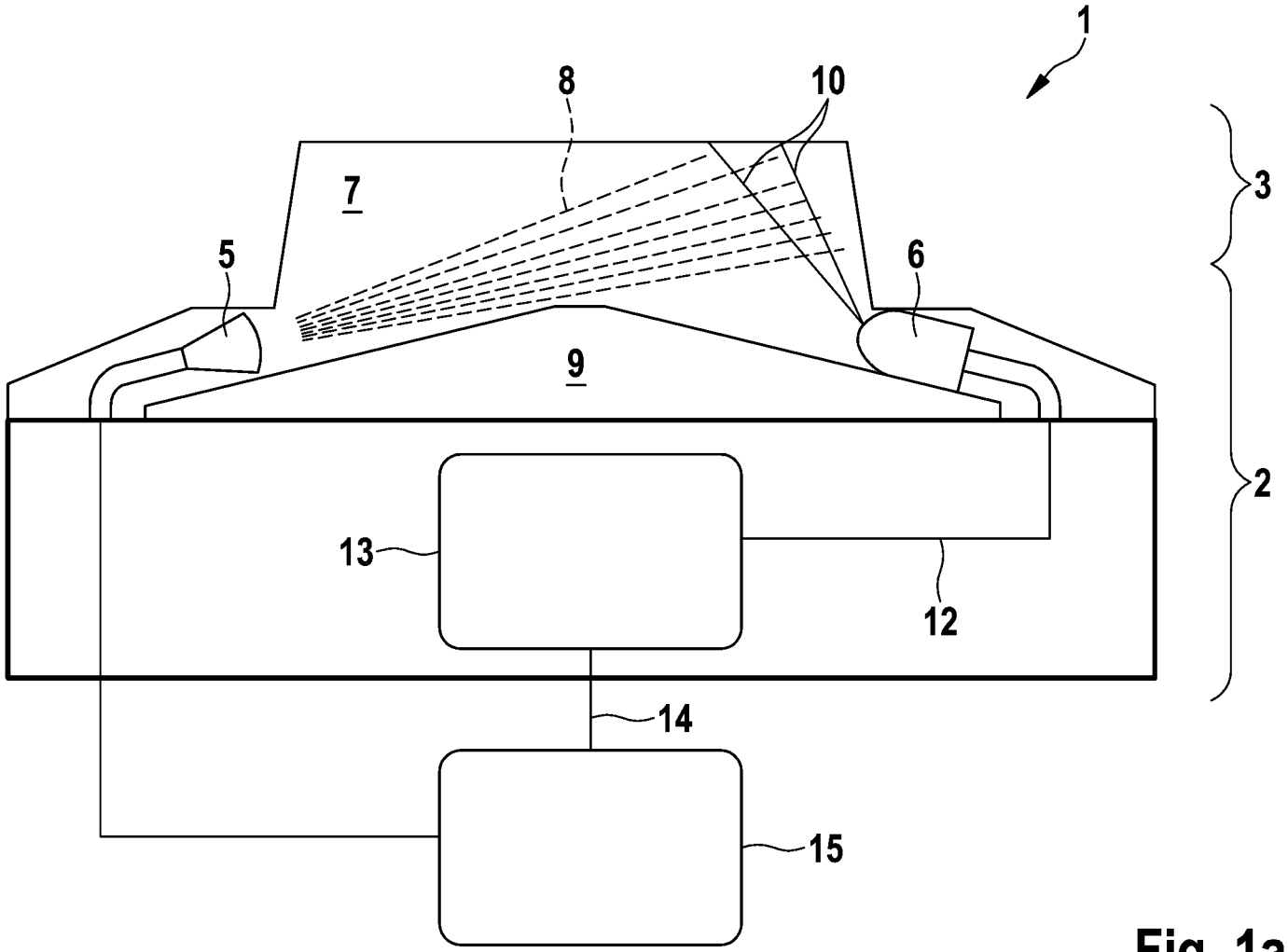
FIG. 1 *a, b, c* a schematic view of a photoelectric smoke detector as an embodiment of the invention in three different states.

FIGS. 1 *a, b, c* show a schematic view of a photoelectric smoke detector 1 as an embodiment of the invention in three different operational states. The photoelectric smoke detector 1 comprises a bottom portion 2 and a labyrinth portion 3. Usually the photoelectric smoke detector 1 is mounted to a wall or a ceiling with its bottom portion, so that the labyrinth portion extends freely in the environment.

The photoelectric smoke detector 1 is operable to sense the presence of smoke particles 4 (FIG. 1*b*) and to generate or to initiate an alarm signal. The photoelectric smoke detector 1 may be realized as a stand-alone system or may be part of a fire monitoring system comprising a plurality of such photoelectric smoke detectors 1 or other fire or smoke detectors.

The photoelectric smoke detector 1 comprises a LED 5 as a light emitting element and a photodiode 6 as light receiving element. The optical axes of the LED 5 and the photodiode Intersect or at least are arranged adjacent in an intersection area 7 in the labyrinth portion 3. The intersection area 7 is fluidly coupled to the environment, so that smoke particles 4 are able to enter the labyrinth portion 3 and especially the intersection area 7. But the intersection area 7 is enclosed in the labyrinth portion 3 so that no disturbing light from the environment can reach the photodiode 6.

In normal operation mode as shown in FIG. 1*a* the LED 5 emits light 8 pulses with a duration or pulse length (FWHM) of e.g. 200 JJs. Due to the orientation of the optical axis of the LED 5 and the photodiode 6 no direct light can reach the photodiode 6. Optional a separating geometry 9 may be provided, that shadows the photodiode 6 from the light 8 from the LED 5. Only some light is scattered as noise light 10 from the inner walls of the labyrinth portion 3 and reaches the LED 6.

Figure 1B:
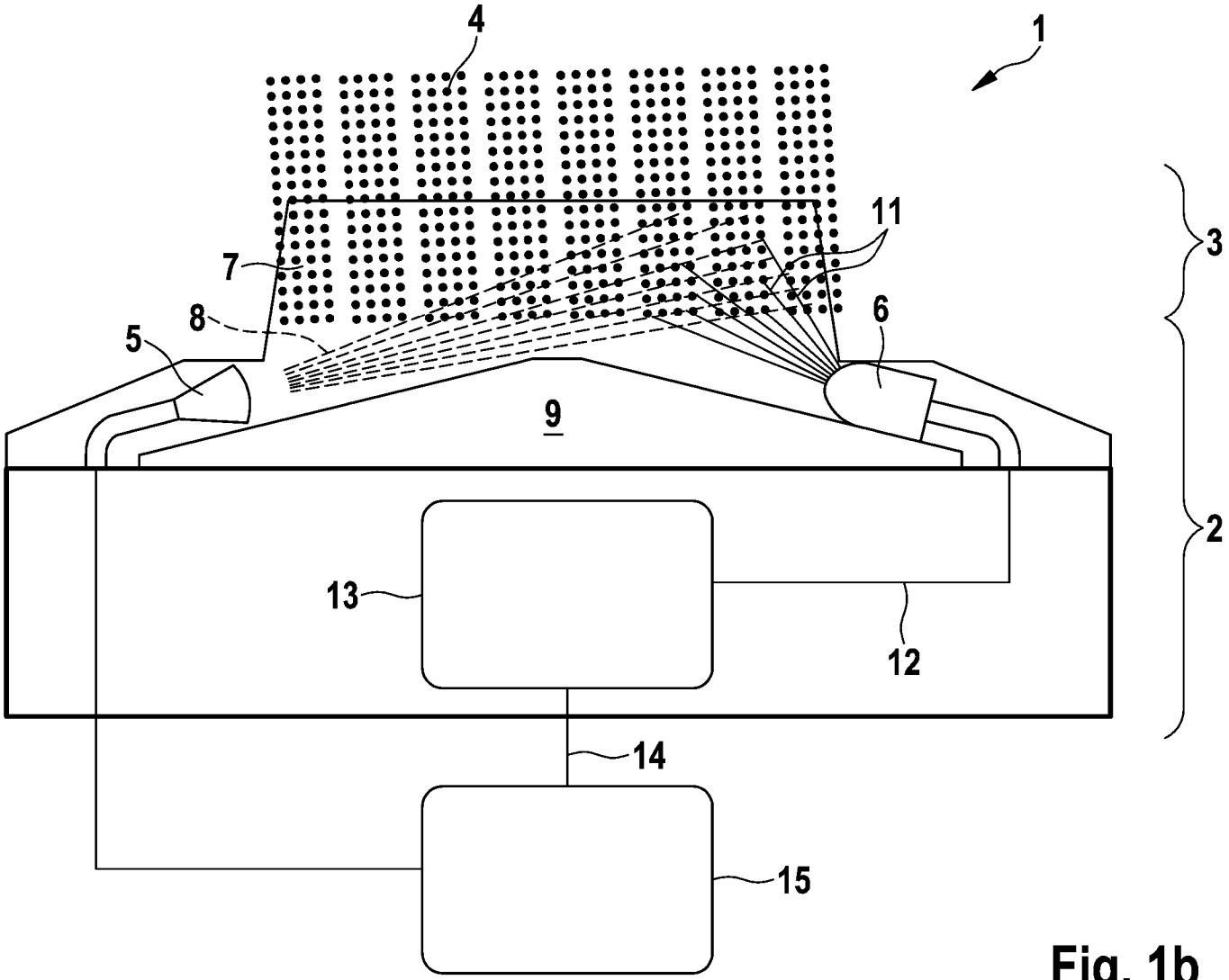

In case of presence of smoke particles 4 as shown in FIG. 1*b*, the photoelectric smoke detector 1 is in alarm operation, whereby light 8 is scattered by the smoke particles 4 and reaches the photodiode 6 as scattered light 11. The amount of light reaching the photodiode 6 is higher than in FIG. 1*a*.

Figure 1C:
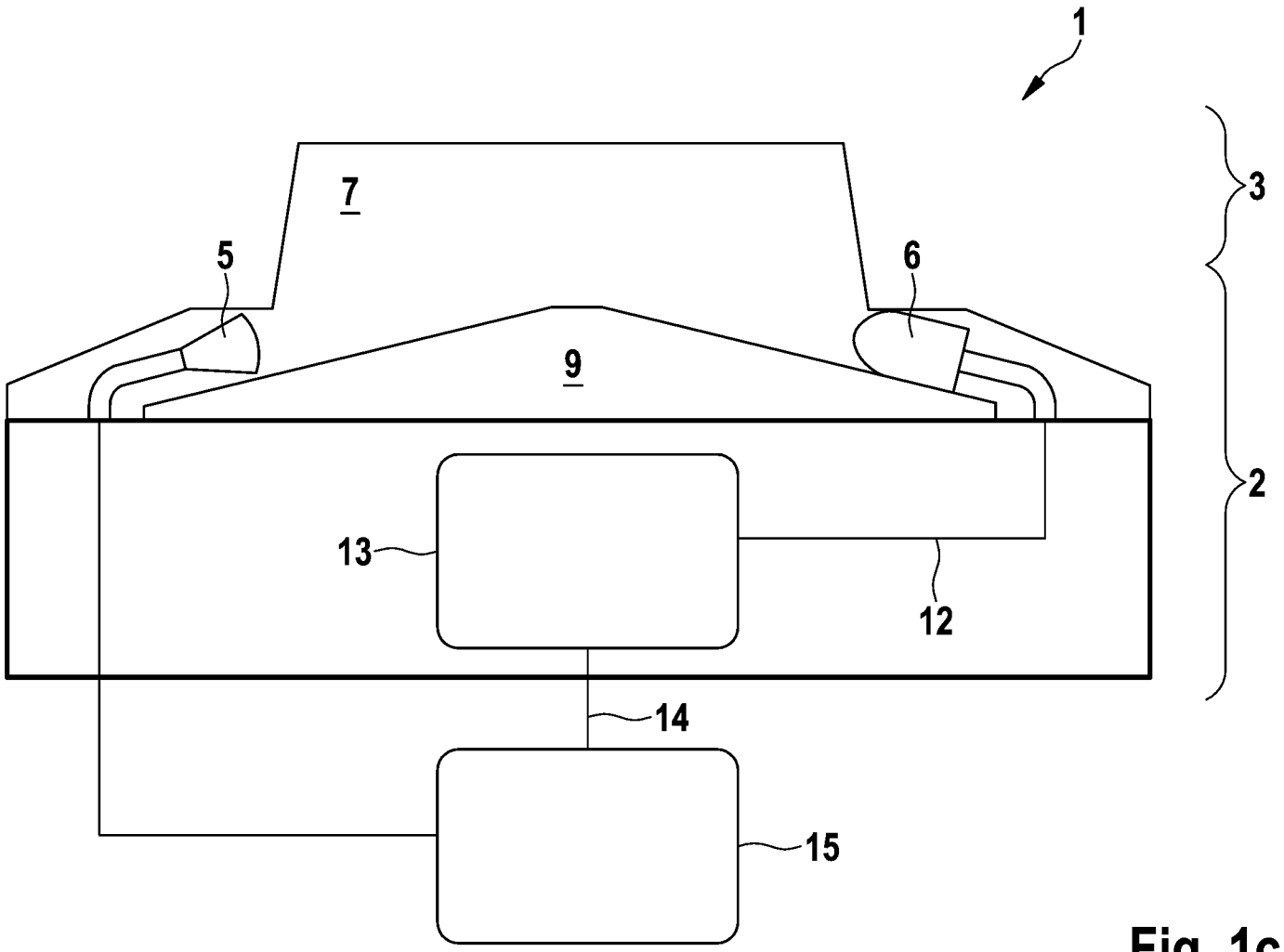

FIG. 1*c* finally shows the photoelectric smoke detector 1 in a deactivated operation, whereby the LED 5 is deactivated. In this operational state nor noise light 10 neither scattered light 11 can reach the photodiode 6.

The light 8 collected by the photodiode 6 is electrically converted into a detection signal 12, which is fed into an amplifier circuit 13 generating an amplified output signal 14. The amplified output signal 14 is passed over to an evaluation module 15.

Figure 2:
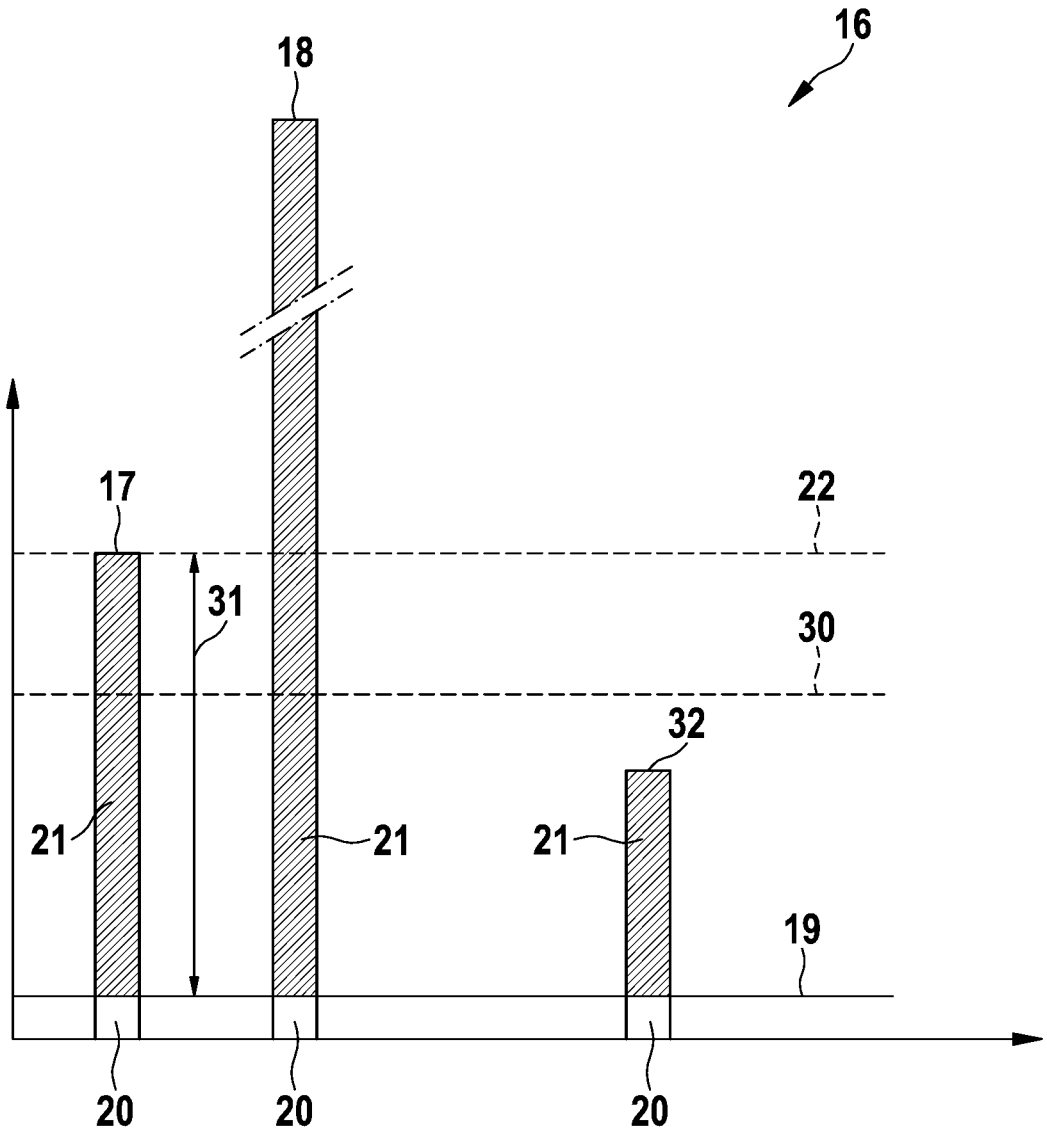
FIG. 2 a graph illustrating signal levels of the photoelectric smoke detector in FIG. 1 *a, b, c*

FIG. 2 shows a graph 16 illustrating different signal levels and thresholds in connection with the amplified output signal 14. The x-axis is a time axis, the y-axis represents a signal amplitude or value.

The first peak 17 is the amplified output signal 14 obtained as a reaction to a light pulse from the LED 5 in the operational mode as shown in FIG. 1*a* without any smoke particles. The second peak 18 is the amplified output signal 14 also obtained as a reaction to a light pulse from the LED 5 in the alarm mode as shown in FIG. 1*b* with smoke particles 4. Obviously, the signal peak 18 is higher than the signal peak 17. The two parallel lines indicate a "broken peak", so that the peak 18 may be even higher as shown in the graph 16.

The first signal threshold line 19 indicates the signal level, which is retrieved as the amplified output signal 14 in case of a deactivated LED 5 as shown in FIG. 1*c*. The first signal threshold line 19 represents thus an offset-signal 20, which is present in each peak 17, 18 of the amplified output signal 14. As the signal level of the first signal threshold line 19 is a static value or nearly static value, the 30 offset-signal 20 of the peaks 17, 18 are low-frequency components of the respective amplified output signals 14.

The remaining portion of the peaks 17, 18 of the amplified output signal 14 are high-frequency-components resulting from the light pulse received by the photodiode 6 and amplified by the amplifier circuit 13 and represent thus the amplified detection signal 21. The high-frequency-components of the amplified output signal 14 are the information carrying portion.

The signal level of peak 17 defines a second signal threshold line 22 and represents a quiescent value for the operation mode as shown in FIG. 1*a*. The ratio between the amplified detection signal 21 and the offset-signal 20 is equal or higher than 5:1 in the operation mode. For example the first signal threshold line 22 or the offset-signal has a value of 2 digits. The value of the second signal threshold line 22 has the value of 22 digits. Consequently, the said ratio is (22−2):2=10:1

As it is known that the offset-signal 20 and thus the first signal threshold line 19 is temperature dependent it is an advantage of the photoelectric smoke detector 1 that the said ratio is high, because temperature effects on the offset-signal 20 does not or does only minor affect the amplitude or signal value of the peaks 17, 18.

The reason for that good ratio can be found in the measurement principle in connection with an adapted amplifier circuit 13. It is one finding that—in case the photoelectric smoke detector 1 is operated in a pulsed mode—the information carrying portion of the amplified output signal 14 represented by the peaks 17, 18 is the amplified detection signal 21 and not the offset-signal 20. As a consequence from the measurement principle, the amplified detection signal 21 carries the high-frequency components and the offset-signal 20 carries the low-frequency components. This a-priori knowledge can be used in order to adapt the amplifier circuit 13, so that high-frequency components are transferred with a higher gain than the low-frequency components. This adaptation of the amplifier circuit 13 leads to an increase of the said ratio and to an improvement of the photoelectric smoke detector 1.

Figure 3:
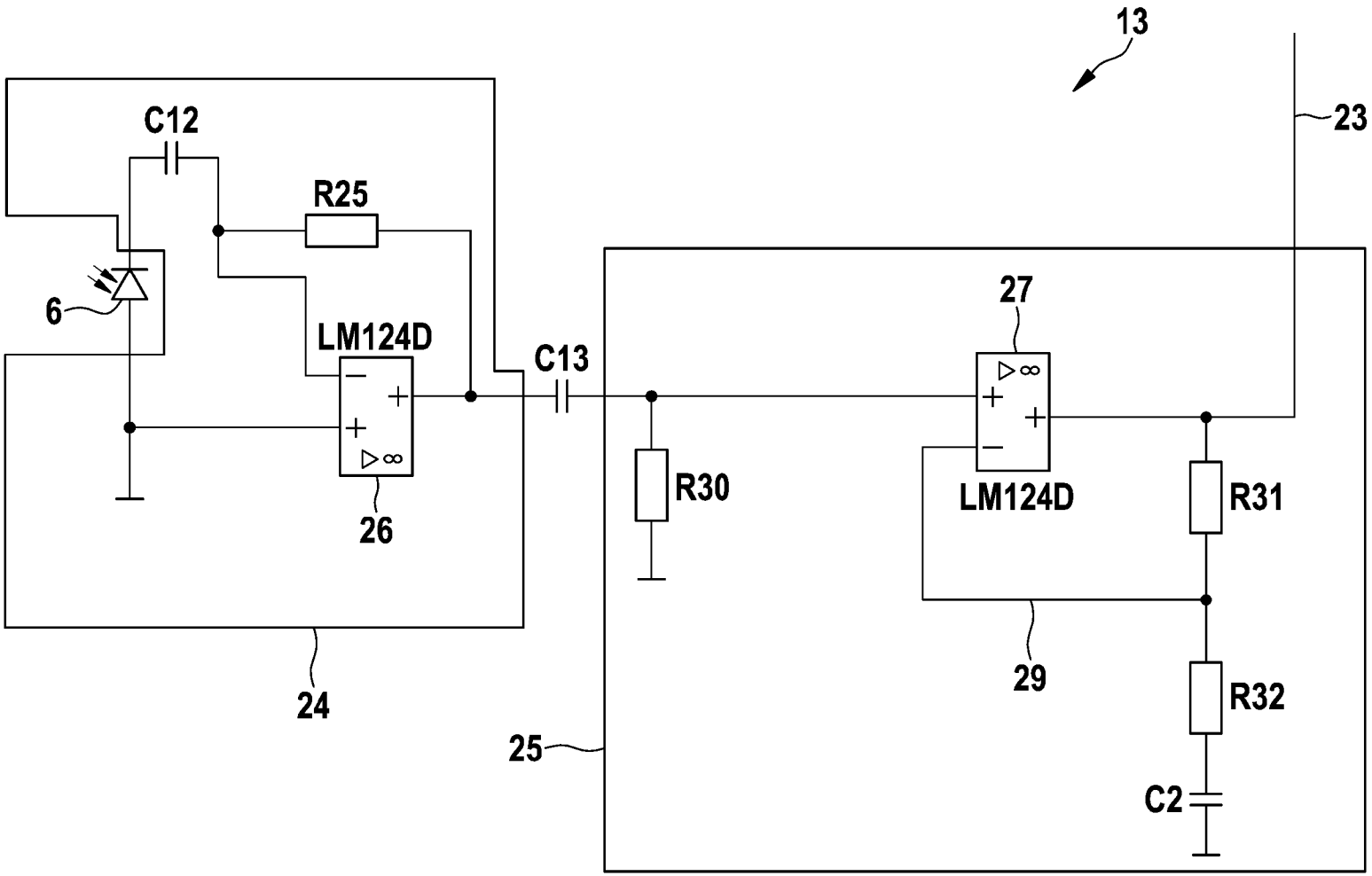
FIG. 3 a circuit diagram of an amplifier circuit for the photoelectric smoke detector according to the preceding figures.

FIG. 3 shows a circuit diagram of the amplifier circuit 13 in FIGS. 1 *a, b, c*. The amplifier circuit 13 is connected to the photodiode 6 on an input side and comprises an output 23, which is connected to the evaluation module 15. The amplifier circuit 13 comprises a pre-amplification stage 24 and a main amplification stage 25. The pre-amplification stage 24 is realized as a current-voltage-converter on basis of a first operational amplifier 26. In the pre-amplification stage 24 the current signal of the photodiode 6 is converted into a voltage signal. The voltage signal is an intermediate signal based on the detection signal from the photodiode 6 in the signal path between input-side and output 23 of the amplifier circuit 13. Between the pre-amplification stage 24 and the main amplification stage 25 a capacitor C13 is coupled in series, so that the two said stages are de-isolated. As a technical effect of the de-isolation, no low-frequency components of the intermediate signal are transferred to the main amplification stage 25. This is a first measure to improve the signal ratio as described above.

The main amplification stage 25 comprises a second operational amplifier 27 which is operated as a voltage-voltage amplifier. The main amplification stage 25 has a negative feedback-branch 29 coupling back the signal output of the second operational amplifier 27 to the inverting input of the second operational amplifier 27. Especially due to the capacitor C2, which is connected between the feedback-branch 29 and the ground in series, a high-pass-filter is established, so that the low-frequency components are coupled back with a higher signal level than the high-frequency components. With the technical data as shown in FIG. 3 of the feedback-branch 29 for the main amplification stage 25 a gain for the low-frequency components of 1 and a gain for the high-frequency components of about 60 is reached. The use of the main amplification stage 25 providing a higher gain for the high-frequency components and a lower gain for the low-frequency components of the detection signal 12 or the intermediate signal is a second measure to improve the signal ratio as described above.

Summarized, the amplifier circuit 13 in its entirety is adapted to transfer the high-frequency components with a higher gain and to transfer the low-frequency components with a lower gain in order to improve the signal ratio between the amplified detection signal 21 and the offset-signal 20.

To ensure a good operating condition of the photoelectric smoke detector 1, it is possible to perform a self-test. The process for testing can be performed by the evaluation module 15, which may be arranged separately to the bottom portion as indicated in the FIGS. 1 *a, b, c* or may be integrated in it. Optionally the evaluation module is operable or adapted to trigger or control the LED 5. In other embodiments controlling of the LED 5 is performed by another control module.

The process for testing is quite simple as a single light pulse emitted from the LED 5 and an evaluation of the amplified output signal is sufficient. Optionally a plurality of light pulses may be used for enhancing a statistical confidence level of the self-test. In a first step the LED 5 is activated to emit a single light pulse. The light pulse has a pulse duration like the light pulses during normal operation.

As the intersection area 7 should be free from any disturbing material, the situation as shown in FIG. 1*a* should be met, i.e. only noise light 10 obtained by scattering the light 8 at the walls of the labyrinth portion 3 should be guided to the photodiode 6. As explained above, the peak 17 should be generated by the amplifier circuit 13 and the amplified output signal 14 is transferred to the evaluation module 15.

In dependency of the embodiment of the photoelectric smoke detector 1 different ways of evaluating may be executed:

In a first possible test procedure, the maximum value of the peak 17 is compared with an expectation value 30. This test procedure assumes that the offset-signal 20 is negligible.

In a second possible test procedure, the maximum value of the amplified detection signal 21 is compared with another expectation value. The second test procedure corrects the maximum peak value by subtracting the offset-signal 20, so that only the amplified detection signal 21 is evaluated, which is indicated by the arrow 31. The offset-signal 20 may be provided as a constant value or may be measured by using the deactivated situation in FIG. 1*c*.

The peak 32 in FIG. 2 shows the situation, in which the intersection 7, the LED 5 or the photodiode 6 is/are soiled or alternatively the amplifier circuit 13 or other parts of the electronic are damaged. Although the test conditions are identical compared to the peak 17, the peak 32 is significantly lower than the peak 17. As the maximum value of the peak 17 is smaller than the expectation value 30 the photoelectric smoke detector 1 is tested as nOK. Alternatively the maximum value of the amplified detection signal 21 is evaluated as described above.

The invention claimed is:

1. A photoelectric smoke detector (1) for detecting smoke particles (4), the smoke detector (1) comprising:

a light emitting element (5), a light receiving element (6) for receiving light (8) emitted by the light emitting element (5) and scattered by the smoke particles (4) and for outputting a detection signal (12) obtained by photo-electrically converting the received light (10, 11), an amplifier circuit (13) for amplifying the detection signal (12) and providing an amplified output signal (14), wherein the amplified output signal (14) may be divided into an offset-signal (20) and an amplified detection signal (21), whereby the photoelectric smoke detector (1) is adapted to operate in a pulsed mode, so that the detection signal (12) comprises high-frequency components, characterized in that the amplified detection signal (21) is determined by high-frequency components of the detection signal (12) and that the offset-signal (20) is determined based on the detection signal (12), whereby the amplifier circuit (13) is adapted to transfer the high-frequency components with a higher gain and to transfer the low-frequency components with a lower gain in order to improve the signal ratio between the amplified detection signal (21) and the offset-signal (20).

2. The photoelectric smoke detector (1) according to claim 1, characterized in that in the normal operation mode of the photoelectric smoke detector (1) the ratio between the amplified detection signal (21) and the offset-signal (20) is better than 5:1, preferably better than 8:1 and especially better than 10:1.

3. The photoelectric smoke detector (1) according to claim 1, characterized in that a pulse is defined as an activation of the light emitting element (5) with a duration smaller than 10 ms, preferably smaller than 5 ms, especially smaller than 1 ms.

4. The photoelectric smoke detector (1) according to claim 1, characterized in that the amplifier circuit (13) comprises a main amplification stage (25) which is adapted to amplify the high-frequency components with a first gain and to amplify offset-signals of the amplifier circuit (13) as part of the low-frequency components with a second gain, whereby the first gain is higher than the second gain.

5. The photoelectric smoke detector (1) according to claim 4, characterized in that main amplification stage (25) comprises an operational amplifier (27) having an inverting input and an output, whereby the output is coupled to the inverting input providing a negative feedback branch (29) and whereby the negative feedback branch (2) is adapted to provide a second gain of smaller than 5, preferably smaller than 3 and especially 1 for the low-frequency components and to provide a first gain of larger than 10, preferably larger than 30 and especially larger than 50 for the high-frequency components.

6. The photoelectric smoke detector (1) according to claim 4, characterized in that the amplifier circuit (13) comprises an pre-amplification stage (24), whereby the main amplification (25) stage is DC or low-frequency isolated from the pre-amplification stage (24).

7. The photoelectric smoke detector (1) according to claim 6, characterized in that the main amplification stage (25) is DC isolated from the pre-amplification stage by a capacitor (C13).

8. A process for testing the photoelectric smoke detector (1) according to claim 1, characterized by the steps:

activating the light emitting element (5) in a test mode for at least one pulse;

detecting the amplified output signal (14) obtained as a response on the emitted at least one pulse as a test output signal;

comparing the test output signal with a reference signal.

9. The process for testing the photoelectric smoke detector (1) according to claim 8, characterized in that an amplified output signal (14) obtained by the photoelectric smoke detector (1) with deactivated light emitting element (5) is used as the reference signal.

10. The process for testing the photoelectric smoke detector (1) according to claim 8, characterized in that a maximum value and a signal behavior of the test output signal and the reference signal is compared.

11. The process for testing the photoelectric smoke detector (1) according to claim 10, characterized by setting a limit value based on the result of the comparison.

12. The photoelectric smoke detector (1) according to claim 1, wherein the offset-signal (20) is determined by low-frequency components of the detection signal (12).

13. The photoelectric smoke detector (1) according to claim 1, wherein the offset-signal (20) is determined the offset-signal (20) is determined by low-frequency components of at least an intermediate signal based on the detection signal (12).

14. The photoelectric smoke detector (1) according to claim 1, wherein the offset-signal (20) is determined the offset-signal (20) is determined by low-frequency components of the detection signal (12) and by low-frequency components of at least an intermediate signal based on the detection signal (12).

15. The photoelectric smoke detector (1) according to claim 6, characterized in that the main amplification stage (25) is low-frequency isolated from the pre-amplification stage by a capacitor (C13).

16. A process for testing the photoelectric smoke detector (1) according to claim 1, characterized by the steps:

activating the light emitting element (5) in a test mode for at least one pulse;

detecting the amplified output signal (14) obtained as a response on the emitted at least one pulse as a test output signal;

comparing the test output signal with a characteristic data.

17. The process for testing the photoelectric smoke detector (1) according to claim 8, characterized in that a maximum value of the test output signal and the reference signal is compared.

18. The process for testing the photoelectric smoke detector (1) according to claim 8, characterized in that a signal behavior of the test output signal and the reference signal is compared.

* * * * *